US010967287B2

(12) United States Patent
Miller et al.

(10) Patent No.: US 10,967,287 B2
(45) **Date of Patent: *Apr. 6, 2021**

(54) BOBBLE FOR BOTTLE NECK

(71) Applicants: Michael Miller, New Orleans, LA (US); Valerie B Miller, New Orleans, LA (US)

(72) Inventors: Michael Miller, New Orleans, LA (US); Valerie B Miller, New Orleans, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/042,316

(22) Filed: Jul. 23, 2018

(65) Prior Publication Data

US 2018/0326316 A1 Nov. 15, 2018

Related U.S. Application Data

(63) Continuation of application No. 15/206,578, filed on Jul. 11, 2016, now Pat. No. 10,029,186.

(51) Int. Cl.
*A63H 3/00* (2006.01)
*A63H 33/00* (2006.01)
*A63H 3/50* (2006.01)

(52) U.S. Cl.
CPC ..... *A63H 33/00* (2013.01); *A63H 3/003* (2013.01); *A63H 3/50* (2013.01)

(58) Field of Classification Search
CPC ..... A63H 3/00
USPC ..... 446/71–74, 77, 227; 215/386, 400; 248/102–104; D9/436
See application file for complete search history.

(56) References Cited

U.S. PATENT DOCUMENTS 2,744,646 A * 5/1956 Blackstone ..... A61J 11/0055 215/11.1
2,955,382 A * 10/1960 Boles ..... A63H 33/00 215/11.1
3,405,829 A * 10/1968 Siravo ..... A61J 9/08 215/11.1
4,902,261 A * 2/1990 Pratt ..... A61J 9/00 215/11.1
5,530,970 A * 7/1996 Knutson ..... G09F 21/02 2/209.13
5,702,039 A * 12/1997 Olaiz ..... A63H 33/006 224/250
5,880,811 A * 3/1999 Parisi ..... A61H 5/00 248/106
6,047,709 A 4/2000 Tu
6,244,544 B1 6/2001 Kitscha et al.
6,513,167 B1 * 2/2003 Cheng ..... A45D 8/36 2/171
D477,781 S 7/2003 Lavallee
(Continued)

*Primary Examiner* — Kurt Fernstrom
(74) *Attorney, Agent, or Firm* — Keaty Law Firm LLC; Thomas S. Keaty

(57) ABSTRACT

A bobble for bottle neck apparatus and method providing a sleeve for a bottle neck which holds a contoured brace having a nipple which protrudes through a slit in the sleeve, whereby a spring is connected on one end to the nipple of the contoured brace and on the other end to a bobble figurine representing one of a range of symbols, persons, holidays, events, sports teams, logos, and the like, such that the bobble figurine is held extended from the bottle neck and can move about by the flexing of the spring. The bobble figurine is removable and substitutable.

4 Claims, 6 Drawing Sheets

(56) References Cited

U.S. PATENT DOCUMENTS

| | | | | |
|---|---|---|---|---|
| 6,626,184 | B1 * | 9/2003 | Cheng | A45D 8/36 132/275 |
| 6,666,417 | B1 * | 12/2003 | Wright | A61J 9/08 248/102 |
| 7,029,360 | B1 | 4/2006 | Hawkins | |
| D601,018 | S | 9/2009 | Trayser | |
| 7,661,636 | B1 * | 2/2010 | Burke | A61J 9/06 248/102 |
| 8,727,150 | B2 * | 5/2014 | Lemke | B65D 81/366 215/228 |
| D715,487 | S * | 10/2014 | Nome | A45D 8/36 D28/41 |
| 9,220,662 | B2 * | 12/2015 | Amitai | A61J 9/0676 |
| 2003/0226298 | A1 | 12/2003 | Bjork | |
| 2005/0000930 | A1 * | 1/2005 | Weissberg | A61J 9/00 215/11.6 |
| 2005/0150902 | A1 * | 7/2005 | Cho | B65D 51/2892 206/219 |
| 2008/0149672 | A1 * | 6/2008 | Frauhiger | A45F 5/00 224/148.6 |
| 2011/0254225 | A1 | 10/2011 | Doherty et al. | |
| 2013/0043245 | A1 | 2/2013 | Griffis | |

* cited by examiner

BOBBLE FOR BOTTLE NECK

CROSS-REFERENCE TO RELATED APPLICATIONS

This is a continuation application of my application Ser. No. 15/206,578, filed on Jul. 11, 2016 for a "Bobble for Bottle Neck," now U.S. Pat. No. 10,029,186, issued on Jul. 24, 2018, the full disclosure of which is incorporated by reference herein and priority of which is hereby claimed.

BACKGROUND

This invention provides a bobble for bottle neck apparatus and method.

Figurines, of generally hand-holdable size, can be fashioned to represent any of a large range of symbols, persons, holidays, events, sports teams, logos, and the like. A figurine can be a source of amusement for the owner, but can also be a means of communicating or signaling outlooks, affiliations, and beliefs to others in an amusing way. Many individuals are inclined to wear or carry figurines of various kinds out in public and to public events in order to broadcast the individual's point of view. Although the chosen figurine could be upsetting or confrontational, very often an amusing figurine is wanted in order to invite friendly attention, as an ice breaker or a conversation starter.

Often, business, social, or religious groups or organizations provide beverages in bottles or cans, either offered for sale or given away for promotional or relationship-developing purposes. Such an organization may wish to attract attention and convey its message through the provided beverages, so that the individual recipient continues to pay attention to the organization's presence after walking away from the distribution point, and also so that other individuals can be exposed to the message when seeing the first individual walking around with the beverage.

Regarding exposure of a message, a bobbling moving figurine catches attention more effectively than a static figurine. Further, a figurine placed on a beverage container will be seen by the drinker and by persons looking at the drinker. Accordingly, an ability to display such a figurine on a beverage, remove such a figurine as desired, and to substitute such a figurine with an alternative figuring is desirable.

The prior art does not disclose the use of a sleeve for a drinking container in combination with a spring-attached accessory, particularly where such accessories are removable and substitutable.

U.S. Pat. No. 7,029,360, issued to Victor Jonathan Hawkins on Apr. 18, 2006 for a "Bobble Head Fluid Container," discloses an apparatus for human consumption that includes a container. A spring is attached to a screw on a lid disposed at the top of the container. A support member of the bobble head engages a top of the spring. A hole is provided in the container that is adapted to receive a straw. The support member is attached to a head, and the spring supports the head above the lid so it can bobble from side to side, twist around a center axis, or bob up and down. The head is urged downward and protrusions and recesses in the support member and lid act like gear teeth to engage with each other and permit rotating the head and lid simultaneously to loosen or tighten the lid.

U.S. Design Pat. No. D601,018 issued Sep. 29, 2009 to Bradford Trayser for a "Bottle Band."

U.S. Design Pat. No. D477,781 issued Jul. 29, 2003 to Joseph E. Lavallee for a "Wine Bottle Ring."

U.S. Pat. No. 6,047,709, issued Apr. 11, 2000 to Yuan Ming Tu on "Replaceable Hair Decorative Members," covers a hair holding that includes a main body with an outer periphery. A number of first pegs are formed on the outer periphery of the main body. A spring is removably attached to each first peg, and a decorative member with a second peg is removably attached to each spring. Each spring has a first end with a first hole slightly greater than an associated first peg. Each spring has a second end with a second hole slightly greater than the peg of an associated decorative member. The user may change the decorative members whenever she likes, thereby obtaining numerous combinations of the decorative members. The decorative members may also be removed from the main body of the apparatus and thus provide a conventional hair holder.

U.S. Publication No. 2011/0254225 was published Oct. 20, 2011 by Amanda Doherty et al. on "Fashion Accessories and Entertainment Instruments with Personalized Appearances." The Doherty concept discloses fashion accessories and entertainment instruments where accessory pieces can be rearranged instantly on a support. Exemplary embodiments include a game board that can be curled up and wrapped around a wrist. In the reconfigurable band, the band comprises (1) an elongated band body of a length and a width and two ends, the band body having an inner side and an opposing, outer side, where the outer side comprises one or more loop-fastener pieces, and wherein the band body comprises a substantially planar piece of board packed into a band configuration; (2) a pair of band fasteners, one at each end of the band body to form a loop sized to fit around a substantially cylindrical part of the body; and (3) a plurality of accessory items, each affixed with a hook-fastener piece, wherein the loop-fastener pieces cooperate with the hook-fastener pieces to prove detachable and re-attachable fastening of the accessory items to the outer side of the band. The detachable and re-attachable pieces may be used to decorate and reconfigure various objects such as small fashion accessories like wristbands or game board pieces like puzzles. The pieces are fashioned from various materials and rely on fasteners to anchor and release them in such a way that they may be arranged, coordinated, reconfigured, traded, stored, and outfitted in different ways at different times to suit the owner.

U.S. Publication No. 2003/0226298 was published Dec. 11, 2003 by Karl Andrew Bjork and discloses a "Bottle Neck Identification Ring and Method." The Bjork apparatus features a closed, unbroken ring having an identifying member attached thereto, the ring having elasticity for placement on the free end of a bottle neck. The publication also provides for a method of distinguishing a plurality of bottles from one another by placing respective closed rings with distinctive ornamentation on the necks of each of the plurality of bottles.

U.S. Publication No. 2013/0043245, published Feb. 21, 2013 by Shawn Griffis on a "Scented Attachment for Containers," discloses an attachment for providing a scent to a container. The scented attachment may be configured for being associated with a container, such as a drink or a food storage container. In one instance, the attachment is of a size or shape so as to fit around a circumference of the container. In another instance, the attachment may be configured for being associated to the container with a suitable attachment mechanism. For instance, the attachment may include a substrate having a first surface comprising an attachment mechanism for associating the scented attachment to the container and a second surface comprising a scent. Systems including a scented attachment and a container, including their methods of use, are also provided.

U.S. Pat. No. 6,244,544, issued Jun. 12, 2001 to John Kitscha et al., covers a "Method and Apparatus for Holding a Capacitor Without Separable Fasteners." The capacitor holder is used for mounting capacitors used in electronics assemblies into a fixture, as well as mounting other types of components in other panels. The capacitor holder includes a support for receiving the capacitor and a cover for covering the capacitor. The cover and support are attached to each other without the use of separable fasteners. Typically, snap-fit tabs depending from the cover are used to attach the cover to the support with a capacitor therebetween to form an assembly. The assembly is mounted into a fixture panel without the use of separable fasteners. In another typical embodiment, the mounting members are push-in and twist or push-in and snap-fit members integral with the cover. Thus, the capacitor is mounted within a fixture without separable fasteners. A method of aligning the capacitor within the panel is also disclosed.

There is therefore a need in the art for a bottle neck apparatus, and method of providing same, that allows the user to display a bobbling, moving figurine that may represent one of a range of symbols.

There is a further need in the art for such a bottle neck apparatus, and method of providing same, that allows the user to selectively apply, remove, and substitute bobbling, moving figures as desired when utilizing the bobble.

SUMMARY OF THE INVENTION

This invention provides a bobble for bottle neck apparatus and method providing a sleeve for a bottle neck which holds a contoured brace having a nipple which protrudes through a slit in the sleeve, whereby a spring is connected on one end to the nipple of the contoured brace and on the other end to a bobble figurine representing one of a range of symbols, persons, holidays, events, sports teams, logos, and the like, such that the bobble figurine is held extended from the bottle neck and can move about by the flexing of the spring. The bobble figurine is removable and substitutable.

BRIEF DESCRIPTION OF DRAWINGS

Reference will now be made to the drawings, wherein like parts are designated by like numerals, and wherein.

DETAILED DESCRIPTION OF THE INVENTION

Referring to all figures generally, embodiments of the bobble for bottle neck invention method and apparatus 10 are illustrated.

Figure 1:
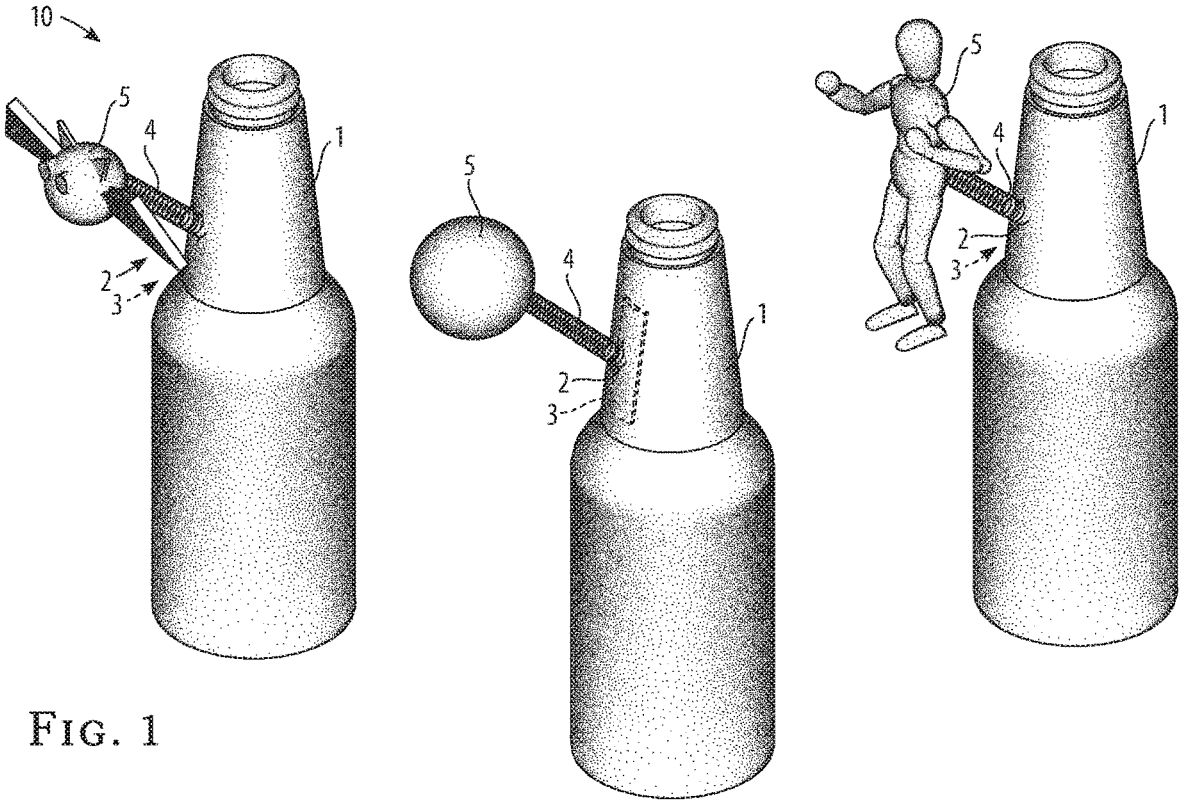
FIG. 1 is a perspective view of embodiments of the bobble for bottle neck invention having various bobble figurines.
Figure 2:
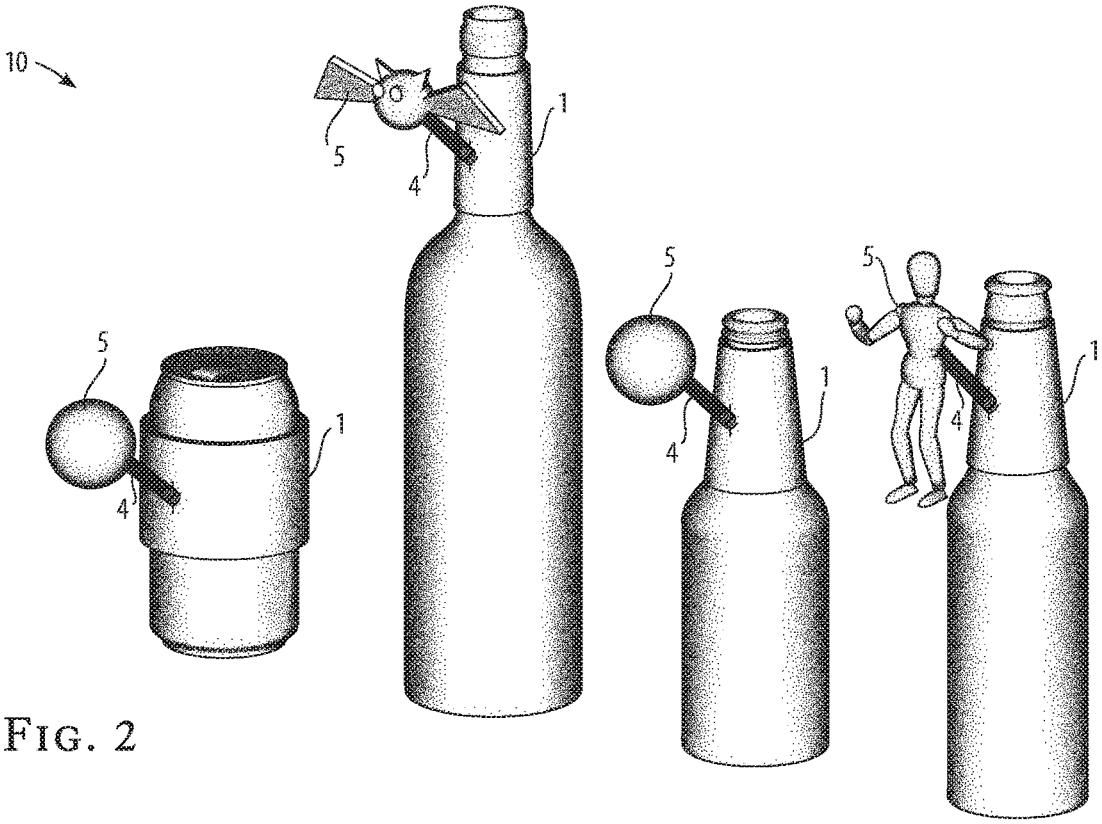
FIG. 2 is a perspective view of embodiments of the bobble for bottle neck invention adapted to various bottles and a can.

Referring to FIG. 1 & FIG. 2, the bobble for bottle neck invention provides a variety of bobble figurines 5, which can be a representation of a range of symbols, persons, holidays, events, sports teams, logos, and the like, such as the sphere and the stylized animal and human shown. The bobble for bottle neck invention also provides sleeves 1 adapted to a variety of beverage containers, including cans, wine bottles, beer bottles, and soft drink bottles, as shown.

Figure 3:
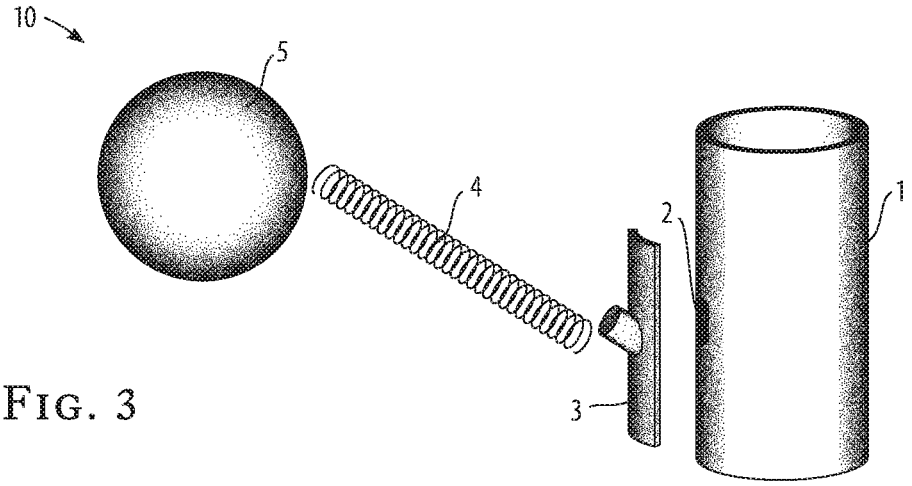
FIG. 3 is an exploded view of a preferred embodiment of the bobble for bottle neck invention.
Figure 4:
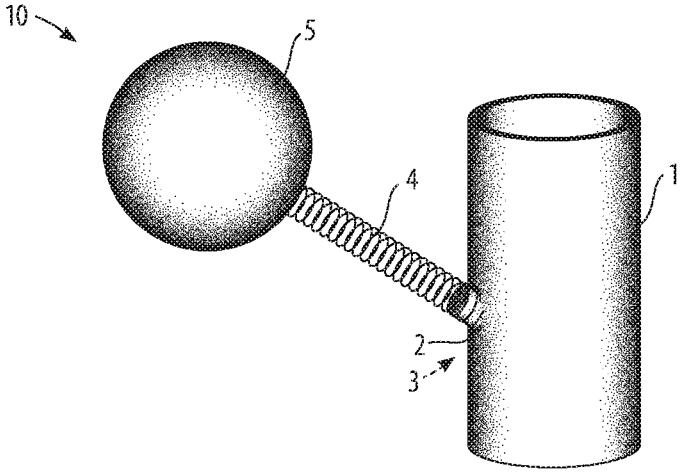
FIG. 4 is an assembled view of a preferred embodiment of the bobble for bottle neck invention.

Referring to FIG. 3 & FIG. 4, the bobble for bottle neck invention provides a sleeve 1 that fits around the neck of a bottle or corresponding parts of different beverage containers. In a preferred embodiment of the bobble for bottle neck invention, the sleeve is made of neoprene fabric, which stretches to conform to the shape of the bottle neck and maintains a tight fit around the bottle neck. The sleeve 1 has a slit 2 for the purpose of allowing the nipple portion of a contoured brace 3 to protrude through the sleeve 1. Depending on the material chosen for the sleeve 1, the ends or edges of the slit might need to be bound or otherwise reinforced against tearing or unravelling.

The contoured brace 3, in use, has a longer dimension in the vertical direction, in line with the bottle's neck, and a shorter dimension in the horizontal direction which is contoured or curved to fit around the bottle's neck. The contoured brace 3 is thin, and is intended to be held tightly around the bottle's neck by the sleeve 1, and is intended to resist the forces exerted by the bobble figurine 5 moving around at the end of a spring 4. In a preferred embodiment of the bobble for bottle neck invention, the contoured brace 3 is made of molded plastic. The contoured brace 3 has a nipple, as shown, that is intended to protrude through the slit 2 in the sleeve 1, and to provide a point of attachment for one end of a spring 4. In an embodiment of the bobble for bottle neck invention, when oriented for use, the nipple emerges from the contoured brace 3 at an upward angle and consequently holds the spring 4 at an upward angle, which compensates somewhat for the downward pull of the bobbling figurine 5. In use, most of the contoured brace 3, except for the nipple, is concealed behind the sleeve 1, as shown.

The bobbling figurine 5 is attached to the end of the spring 4 opposite the attachment to the nipple of the contoured brace 3. At least one of the attachments to the spring 4, at the contoured brace 3, at the bobbling figurine 5, or at both, is a removable and re-attachable attachment, which allows for removal and substitution of the bobbling figurine 5.

Figure 5:
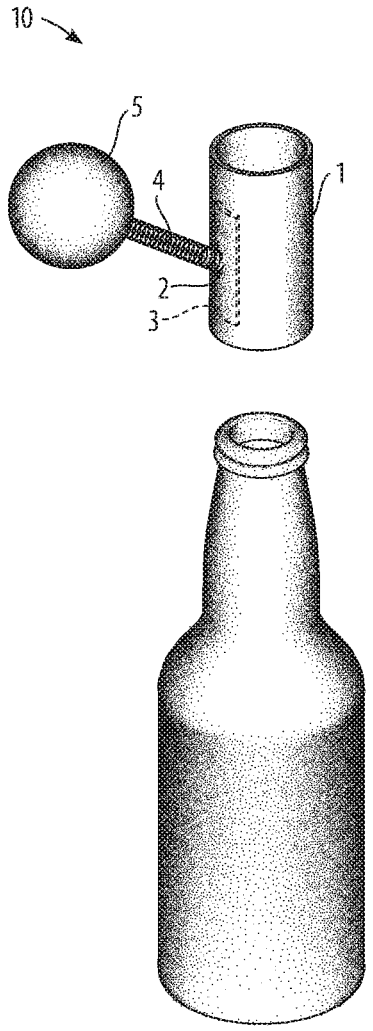
FIG. 5 is a view of a preferred embodiment of the bobble for bottle neck invention prior to placement on a bottle neck.
Figure 6:
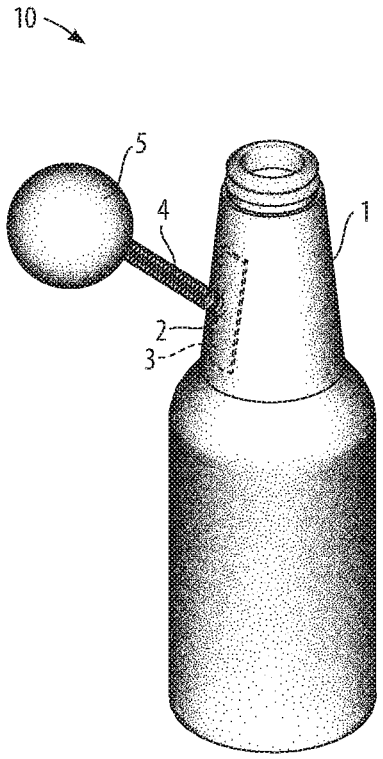
FIG. 6 is a view of a preferred embodiment of the bobble for bottle neck invention after placement on a bottle neck, in use.

Referring to FIG. 5 & FIG. 6, the bobble for bottle neck invention assembly is placed upon, and stretched around, the bottle's neck or the corresponding part of a different beverage container. The sleeve 1 conforms to the bottle's neck and holds the contoured brace 3 tightly against the bottle's neck. The longer dimension of the contoured brace 3, in use, is oriented generally vertically along the bottle's neck, providing a bracing force against the pull of the bobbling figurine 5. In use, the bobble for bottle neck invention holds a bobbling figurine 5 out from the bottle's neck on a spring 4, allowing the bobbling figurine 5 to bobble with movement of the bottle or with touching the bobbling figurine 5 itself.

Figure 7:
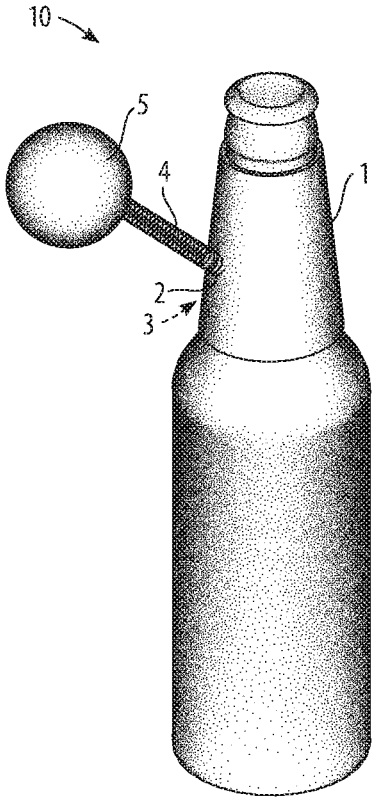
FIG. 7 is a view of an embodiment of the bobble for bottle neck invention in use on a taller beverage bottle.
Figure 8:
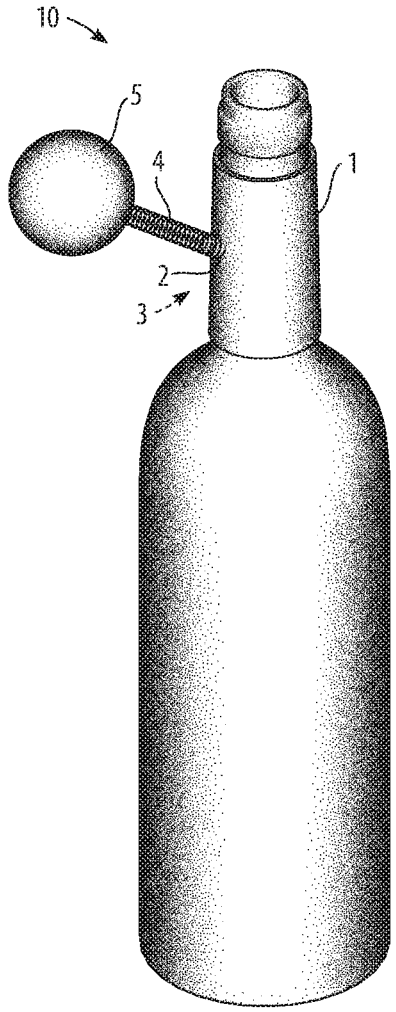
FIG. 8 is a view of an embodiment of the bobble for bottle neck invention in use on a wine bottle.
Figure 9:
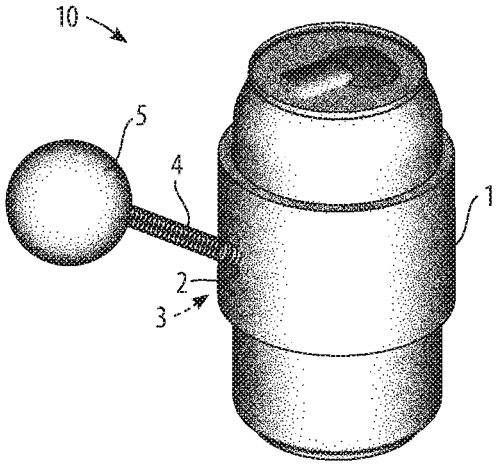
FIG. 9 is a view of an embodiment of the bobble for bottle neck invention in use on a beverage can.

Referring to FIG. 7, FIG. 8, & FIG. 9, the bobble for bottle neck invention can be used on a variety of beverage containers, such as soft-drink bottles or wine bottles, or an embodiment having a larger sleeve 1 can be used on cans.

Figure 10:
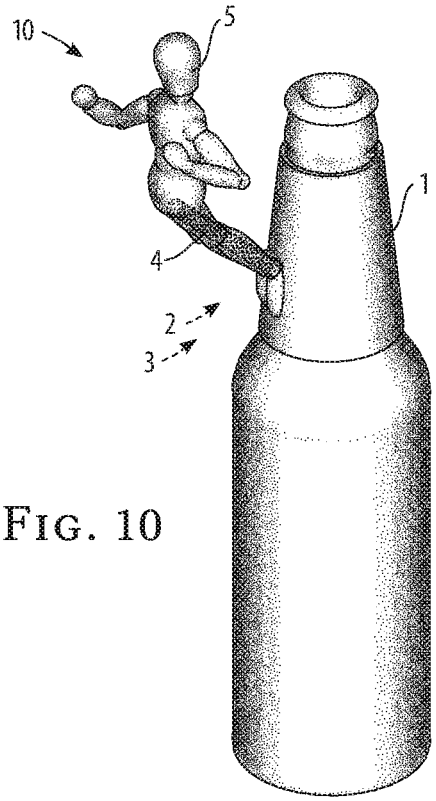
FIG. 10 is a view of an alternative embodiment of the bobble for bottle neck, schematically depicting the internal attachment to the sleeve of the present invention.
Figure 11:
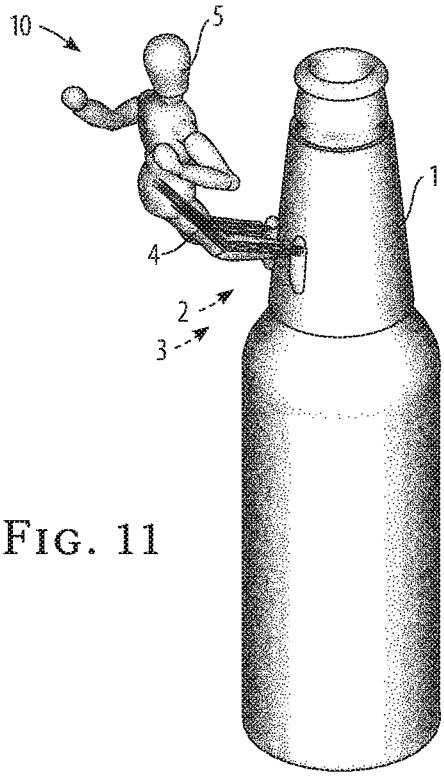
FIG. 11 is a view of an alternative embodiment of the bobble for bottle neck, schematically depicting the internal attachment to the sleeve of the present invention.
Figure 12:
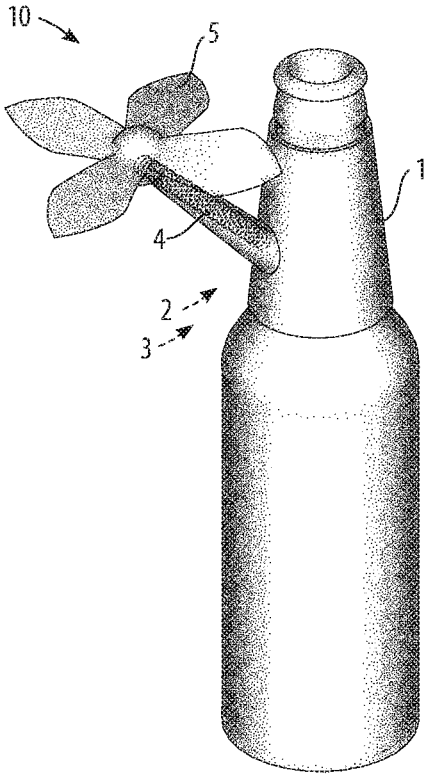
FIG. 12 is a view of an alternative embodiment of the bobble for bottle neck, schematically depicting the internal attachment to the sleeve of the present invention.

Referring to FIG. 10, FIG. 11, and FIG. 12, the bobble for bottle neck invention may alternatively feature a spring 4 that is part of the decorative element of the bobbling figurine 5. For example, referring to FIG. 10, if the bobbling figurine 5 represents a person, the spring 4 may be embedded within the decorative legs of the person of the bobbling figurine 5. As in the embodiments depicted in FIG. 1 and FIG. 2, the sleeve 1 has a slit 2 for the purpose of allowing the nipple of a contoured brace 3 to protrude through the sleeve 1. The spring 4 is attached to the nipple of the contoured brace 3, and the bobbling figurine 5 encases the spring 4 of the bobble. As depicted in FIG. 10 and FIG. 11, in the case of a single spring 4, the bobbling figurine 5 may be removable and re-attachable on the spring 4, such that an alternative bobbling figurine 5 may be attached to the spring 4.

Figure 13:
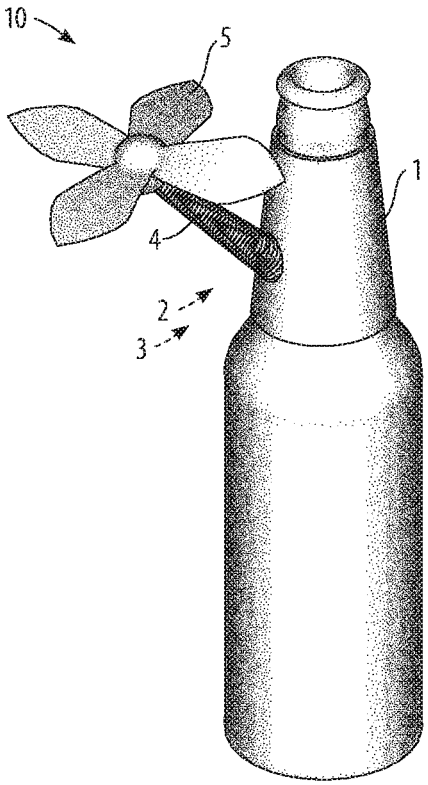
FIG. 13 is a view of an alternative embodiment of the bobble for bottle neck invention after placement on a bottle neck, in use.
Figure 14:
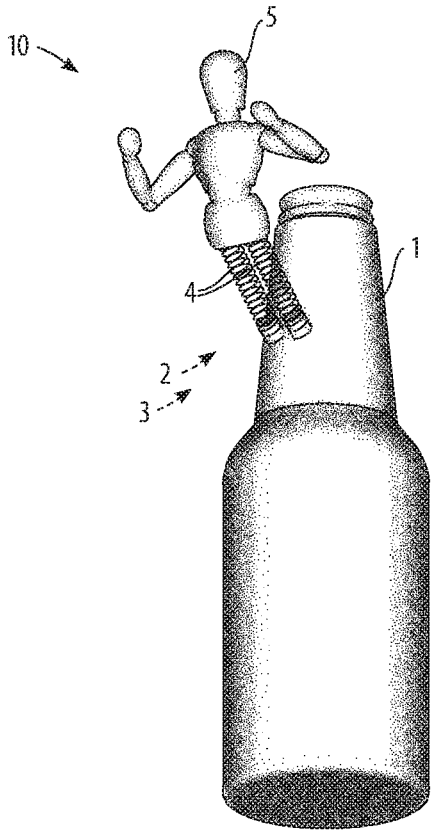
FIG. 14 is a view of an alternative embodiment of the bobble for bottle neck invention after placement on a bottle neck, in use.

Alternatively, referring to FIG. 11, FIG. 13, and FIG. 14, the spring 4 may be directly connected to the bobbling figurine 5. The spring 4 may be encased within the decorative element of bobbling figurine 5, as shown schematically in FIG. 11, or may serve as a decorative element as part of the bobbling figurine 5, as shown in FIG. 13 and FIG. 14.

Many changes and modifications can be made in the present invention without departing from the spirit thereof. I therefore pray that rights to the present invention be limited only by the scope of the appended claims.

What is claimed is:

1. A bobble for bottle neck apparatus, comprising:

(i) a sleeve adapted to fit tightly around a bottle neck, having a generally tubular form in use, and having a slit adapted to allow protrusion through said sleeve;

(ii) a contoured brace adapted to conform to the bottle neck, having a nipple adapted to protrude through said slit;

(iii) a spring having a proximal end and a distal end, adapted to attach at the proximal end to said nipple protruding through said slit; and (iv) a bobbling figurine adapted to attach at the distal end of said spring, said bobbling figurine having a shape and a coloring;

where at least one attachment to said spring is removable and re-attachable;

where, in use, said bobbling figurine is held out from the bottle neck at the distal end of said spring, allowing movement of said bobbling figurine;

where, in use, said contoured brace is held tightly to the bottle neck by said sleeve, providing a bracing resistance to the movement of said bobbling figurine; and where said shape of the bobbling figurine is chosen from shapes representing one of a range of symbols, persons, holidays, events, sports teams, or logos.

2. A bobble for bottle neck apparatus, comprising:

(i) a sleeve adapted to fit tightly around a bottle neck, having a generally tubular form in use, and having a slit adapted to allow protrusion through said sleeve;

(ii) a contoured brace adapted to conform to the bottle neck, having a nipple adapted to protrude through said slit;

(iii) a spring having a proximal end and a distal end, adapted to attach at the proximal end to said nipple protruding through said slit; and (iv) a bobbling figurine adapted to attach at the distal end of said spring, said bobbling figurine having a shape and a coloring;

where at least one attachment to said spring is removable and re-attachable;

where, in use, said bobbling figurine is held out from the bottle neck at the distal end of said spring, allowing movement of said bobbling figurine;

where, in use, said contoured brace is held tightly to the bottle neck by said sleeve, providing a bracing resistance to the movement of said bobbling figurine; and where said coloring of the bobbling figurine is chosen from colorings representing one of a range of symbols, persons, holidays, events, sports teams, or logos.

3. A method for producing a bobble for bottle neck, comprising:

(i) providing a sleeve adapted to fit tightly around a bottle neck, having a generally tubular form, in use, and having a slit adapted to allow protrusion through said sleeve;

(ii) providing a contoured brace adapted to conform to the bottle neck, having a nipple adapted to protrude through said slit;

(iii) providing a spring having a proximal end and a distal end, adapted to attach at the proximal end to said nipple protruding through said slit; and (iv) providing a bobbling figurine adapted to attach at the distal end of said spring, said bobbling figuring having a shape and a coloring;

where at least one attachment to said spring is removable and re-attachable;

where, in use, said bobbling figurine is held out from the bottle neck at the distal end of said spring, allowing movement of said bobbling figurine;

where, in use, said contoured brace is held tightly to the bottle neck by said sleeve, providing a bracing resistance to the movement of said bobbling figurine; and where said shape of the bobbling figurine is chosen from shapes representing one of a range of symbols, persons, holidays, events, sports teams, or logos.

4. A method for producing a bobble for bottle neck, comprising:

(i) providing a sleeve adapted to fit tightly around a bottle neck, having a generally tubular form, in use, and having a slit adapted to allow protrusion through said sleeve;

(ii) providing a contoured brace adapted to conform to the bottle neck, having a nipple adapted to protrude through said slit;

(iii) providing a spring having a proximal end and a distal end, adapted to attach at the proximal end to said nipple protruding through said slit; and (iv) providing a bobbling figurine adapted to attach at the distal end of said spring, said bobbling figuring having a shape and a coloring;

where at least one attachment to said spring is removable and re-attachable;

where, in use, said bobbling figurine is held out from the bottle neck at the distal end of said spring, allowing movement of said bobbling figurine;

where, in use, said contoured brace is held tightly to the bottle neck by said sleeve, providing a bracing resistance to the movement of said bobbling figurine; and where said coloring of the bobbling figurine is chosen from colorings representing one of a range of symbols, persons, holidays, events, sports teams, or logos.

* * * * *